US010007213B2

(12) United States Patent
Ikebuchi et al.

(10) Patent No.: US 10,007,213 B2
(45) Date of Patent: Jun. 26, 2018

(54) FIXING DEVICE, IMAGE FORMING APPARATUS, AND SLIDE MEMBER

(71) Applicants: Yutaka Ikebuchi, Kanagawa (JP); Hideo Nagafuji, Kanagawa (JP); Kohichi Utsunomiya, Kanagawa (JP); Arinobu Yoshiura, Miyagi (JP); Motoyoshi Yamano, Kanagawa (JP)

(72) Inventors: Yutaka Ikebuchi, Kanagawa (JP); Hideo Nagafuji, Kanagawa (JP); Kohichi Utsunomiya, Kanagawa (JP); Arinobu Yoshiura, Miyagi (JP); Motoyoshi Yamano, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days. days.

(21) Appl. No.: 15/280,313

(22) Filed: Sep. 29, 2016

(65) Prior Publication Data

US 2017/0102646 A1 Apr. 13, 2017

(30) Foreign Application Priority Data

Oct. 8, 2015 (JP) ..... 2015-200456

(51) Int. Cl.
*G03G 15/20* (2006.01)

(52) U.S. Cl.
CPC . *G03G 15/2025* (2013.01); *G03G 2215/2035* (2013.01)

(58) Field of Classification Search
CPC ..... G03G 15/2025
See application file for complete search history.

(56) References Cited

U.S. PATENT DOCUMENTS

| | | | |
|---|---|---|---|
| 2007/0292175 | A1 | 12/2007 | Shinshi |
| 2011/0052245 | A1 | 3/2011 | Shinshi et al. |
| 2011/0058865 | A1 | 3/2011 | Tokuda et al. |
| 2011/0058866 | A1 | 3/2011 | Ishii et al. |
| 2011/0076071 | A1 | 3/2011 | Yamaguchi et al. |
| 2012/0114345 | A1 | 5/2012 | Fujimoto et al. |
| 2012/0121304 | A1 | 5/2012 | Tokuda et al. |
| 2012/0155936 | A1 | 6/2012 | Yamaguchi et al. |
| 2013/0170877 | A1 | 7/2013 | Yoshiura et al. |
| 2013/0170879 | A1 | 7/2013 | Yoshinaga et al. |

(Continued)

FOREIGN PATENT DOCUMENTS

| | | |
|---|---|---|
| JP | 2004-029607 | 1/2004 |
| JP | 2007-334205 | 12/2007 |

(Continued)

*Primary Examiner* — Sevan A Aydin
(74) *Attorney, Agent, or Firm* — Oblon, McClelland, Maier & Neustadt, L.L.P.

(57) ABSTRACT

A fixing device includes a fixing rotator to fix an image on a recording medium, a pressure rotator to press against an outer circumferential surface of the fixing rotator, a nip formation pad disposed inside the fixing rotator and opposite the pressure rotator to form an area of contact between the fixing rotator and the pressure rotator, and a slide member disposed between the fixing rotator and the nip formation pad and applied with lubricant to slide the fixing rotator in a sliding direction. The slide member includes first strands disposed parallel to the sliding direction and second strands disposed perpendicular to the sliding direction and interwoven with the first strands. The first strands are woven over the second strands longer than the second strands woven over the first strands.

7 Claims, 9 Drawing Sheets

(56) References Cited

U.S. PATENT DOCUMENTS

| | | | |
|---|---|---|---|
| 2013/0170880 | A1 | 7/2013 | Gotoh et al. |
| 2013/0177340 | A1 | 7/2013 | Kawata et al. |
| 2013/0183070 | A1 | 7/2013 | Kawata et al. |
| 2013/0189008 | A1 | 7/2013 | Ishii et al. |
| 2013/0195523 | A1 | 8/2013 | Yamaji et al. |
| 2013/0195524 | A1 | 8/2013 | Ishii et al. |
| 2013/0266355 | A1 | 10/2013 | Yoshiura et al. |
| 2014/0241766 | A1 | 8/2014 | Ishii et al. |
| 2015/0023705 | A1 | 1/2015 | Kawata et al. |
| 2016/0223964 | A1 | 8/2016 | Ikebuchi et al. |
| 2016/0274515 | A1 | 9/2016 | Imada et al. |

FOREIGN PATENT DOCUMENTS

| | | |
|---|---|---|
| JP | 2010-140061 | 6/2010 |
| JP | 2013-152268 | 8/2013 |
| JP | 2013-152397 | 8/2013 |
| JP | 2014-164245 | 9/2014 |
| JP | 2014-174358 | 9/2014 |
| JP | 2014-186303 | 10/2014 |
| WO | WO2005/038533 A1 | 4/2005 |

FIXING DEVICE, IMAGE FORMING APPARATUS, AND SLIDE MEMBER

CROSS-REFERENCE TO RELATED APPLICATION

This patent application is based on and claims priority pursuant to 35 U.S.C. § 119(a) to Japanese Patent Application No. 2015-200456, filed on Oct. 8, 2015, in the Japan Patent Office, the entire disclosure of which is hereby incorporated by reference herein.

BACKGROUND

Technical Field

Embodiments of the present disclosure generally relate to a fixing device, an image forming apparatus, and a slide member, and more particularly, to a fixing device for fixing a toner image on a recording medium, an image forming apparatus for forming an image on a recording medium, and a slide member for sliding a fixing rotator that fixes an image on a recording medium.

Related Art

Various types of electrophotographic image forming apparatuses are known, including copiers, printers, facsimile machines, and multifunction machines having two or more of copying, printing, scanning, facsimile, plotter, and other capabilities. Such image forming apparatuses usually form an image on a recording medium according to image data. Specifically, in such image forming apparatuses, for example, a charger uniformly charges a surface of a photoconductor as an image carrier. An optical writer irradiates the surface of the photoconductor thus charged with a light beam to form an electrostatic latent image on the surface of the photoconductor according to the image data. A developing device supplies toner to the electrostatic latent image thus formed to render the electrostatic latent image visible as a toner image. The toner image is then transferred onto a recording medium either directly, or indirectly via an intermediate transfer belt. Finally, a fixing device applies heat and pressure to the recording medium carrying the toner image to fix the toner image onto the recording medium. Thus, the image is formed on the recording medium.

Such a fixing device typically includes a fixing rotator such as a roller, a belt, or a film, and an opposed rotator such as a roller or a belt pressed against the fixing rotator. The toner image is fixed onto the recording medium under heat and pressure while the recording medium is conveyed between the fixing rotator and the opposed rotator.

Such a fixing device may further include a slide member applied with lubricant to smoothly slide, e.g., a fixing belt as a fixing rotator.

SUMMARY

In one embodiment of the present disclosure, a novel fixing device is described that includes a fixing rotator, a pressure rotator, a nip formation pad, and a slide member. The fixing rotator fixes an image on a recording medium. The pressure rotator presses against an outer circumferential surface of the fixing rotator. The nip formation pad is disposed inside the fixing rotator and opposite the pressure rotator to form an area of contact between the fixing rotator and the pressure rotator. The slide member is disposed between the fixing rotator and the nip formation pad, and is applied with lubricant to slide the fixing rotator in a sliding direction. The slide member includes first strands disposed parallel to the sliding direction and second strands disposed perpendicular to the sliding direction and interwoven with the first strands. The first strands are woven over the second strands longer than the second strands woven over the first strands.

Also described is a novel image forming apparatus incorporating the fixing device.

Also described is a novel slide member applied with lubricant to slide a fixing rotator to fix an image on a recording medium. The slide member includes the first strands disposed parallel to a sliding direction in which the fixing rotator slides on the slide member, and the second strands disposed perpendicular to the sliding direction and interwoven with the first strands. The first strands are woven over the second strands longer than the second strands woven over the first strands.

BRIEF DESCRIPTION OF THE DRAWINGS

A more complete appreciation of the disclosure and many of the attendant advantages thereof will be more readily obtained as the same becomes better understood by reference to the following detailed description of embodiments when considered in connection with the accompanying drawings, wherein.

The accompanying drawings are intended to depict embodiments of the present disclosure and should not be interpreted to limit the scope thereof. Also, identical or similar reference numerals designate identical or similar components throughout the several views.

DETAILED DESCRIPTION

Figure 1:
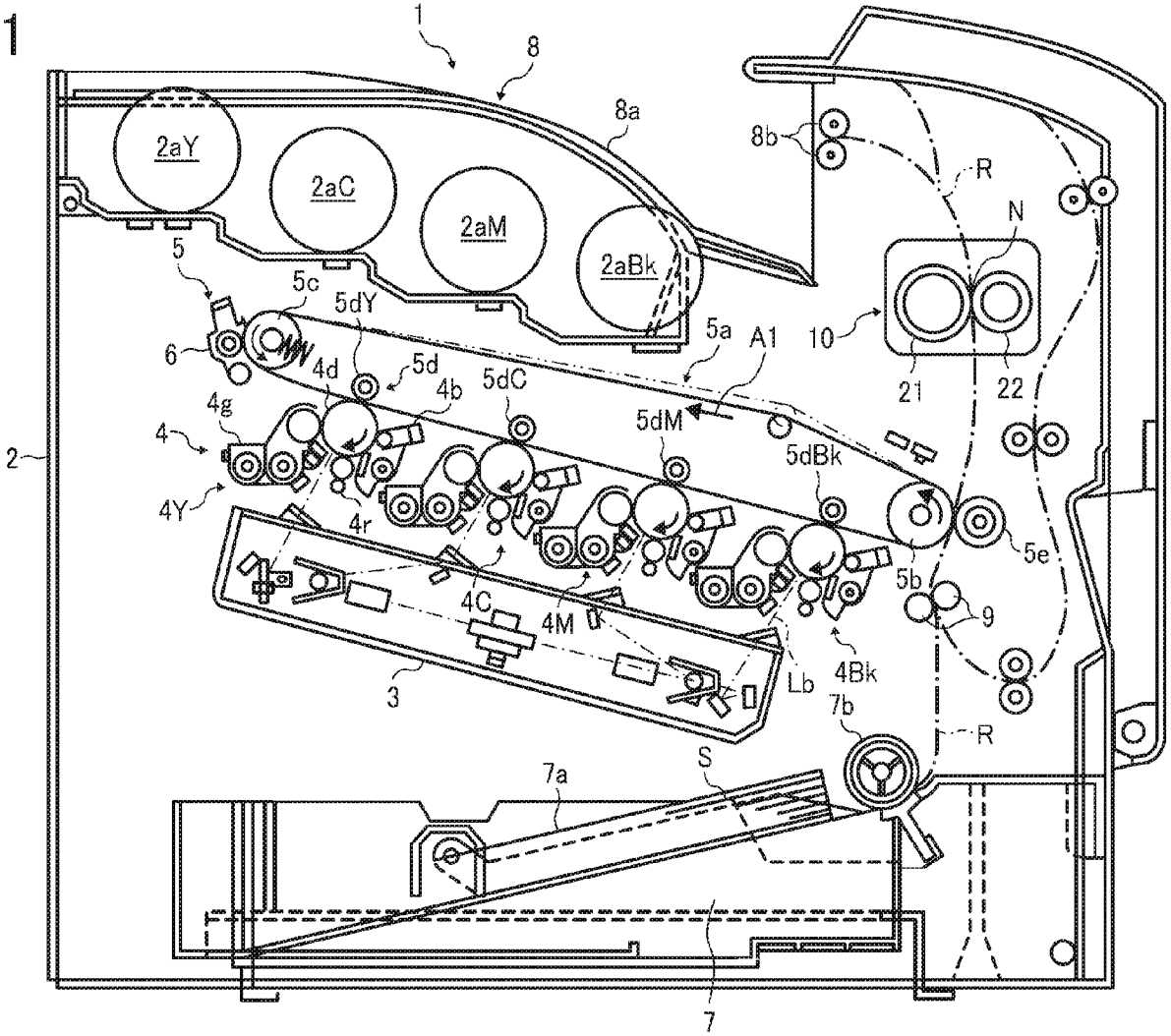
FIG. 1 is a schematic view of an image forming apparatus according to an embodiment of the present disclosure.

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of the present disclosure are not necessarily indispensable to the present disclosure.

In a later-described comparative example, embodiment, and exemplary variation, for the sake of simplicity like reference numerals are given to identical or corresponding constituent elements such as parts and materials having the same functions, and redundant descriptions thereof are omitted unless otherwise required.

As used herein, the singular forms "a", "an", and "the" are intended to include the plural forms as well, unless the context clearly indicates otherwise.

It is to be noted that, in the following description, suffixes Y, C, M, and Bk denote colors yellow, cyan, magenta, and black, respectively. To simplify the description, these suffixes may be omitted unless necessary.

Referring now to the drawings, wherein like reference numerals designate identical or corresponding parts throughout the several views, embodiments of the present disclosure are described below.

Initially with reference to FIG. 1, a description is given of an image forming apparatus 1 according to an embodiment of the present disclosure.

FIG. 1 is a schematic view of the image forming apparatus 1.

The image forming apparatus 1 is a color printer that forms color and monochrome toner images on recording media by electrophotography.

As illustrated in FIG. 1, the image forming apparatus 1 includes a housing 2, an optical writing device 3, a process unit 4 as an image forming device, a transfer device 5, a belt cleaning device 6, a sheet feeding device 7, a sheet ejection unit 8, a registration roller pair 9, and a fixing device 10.

The image forming apparatus 1 has a tandem configuration, in which photoconductive drums 4*d* are arranged side by side, as image bearers to respectively bear toner images of yellow (Y), cyan (C), magenta (M), and black (Bk). It is to be noted that the image forming apparatus according to an embodiment of the present disclosure is not limited to such a tandem image forming apparatus, but may have another configuration. Additionally, the image forming apparatus according to an embodiment of the present disclosure is not limited to the color image forming apparatus 1, but may be another type of image forming apparatus. For example, the image forming apparatus may be a copier, a facsimile machine, or a multifunction peripheral having one or more capabilities of these devices.

The housing 2 accommodates various components. Also, inside the housing 2 is a conveyance passage R, defined by internal components of the image forming apparatus 1, along which a sheet S as a recording medium is conveyed from the sheet feeding device 7 to the sheet ejection unit 8.

The housing 2 also accommodates, e.g., toner bottles 2*a*Y, 2*a*C, 2*a*M, and 2*a*Bk below the sheet ejection unit 8. The removable toner bottles 2*a*Y, 2*a*C, 2*a*M, and 2*a*Bk, contain fresh toner of the colors yellow, cyan, magenta, and black, respectively, and are mounted in the housing 2. The housing 2 also accommodates a waste toner container having an inlet in communication with a toner conveyance tube. The waste toner container receives waste toner conveyed through the toner conveyance tube.

The optical writing device 3 includes a semiconductor laser as a light source, a coupling lens, an f-θ lens, a toroidal lens, a deflection mirror, and a polygon mirror. The optical writing device 3 emits laser beams Lb onto the respective photoconductive drums 4*d* included in the process unit 4, according to yellow, cyan, magenta, and black image data, to form electrostatic latent images on the respective photoconductive drums 4*d*. The yellow, cyan, magenta, and black image data are single-color data, into which a desired full-color image data is decomposed.

The process unit 4 is constituted of four sub-process units 4Y, 4C, 4M, and 4Bk to respectively form toner images of yellow, cyan, magenta, and black. For example, the sub-process unit 4Y includes the photoconductive drum 4*d*. The sub-process unit 4Y also includes a charging roller 4*r*, a developing device 4*g*, and a cleaning blade 4*b* surrounding the photoconductive drum 4*d*. In the sub-process unit 4Y, charging, optical writing, developing, transfer, cleaning, and discharging processes are performed on the photoconductive drum 4*d* in this order.

Specifically, at first, the charging roller 4*r* charges an outer circumferential surface of the photoconductive drum 4*d* electrostatically. The optical writing device 3 conducts optical writing on the charged outer circumferential surface of the photoconductive drum 4*d*, forming an electrostatic latent image constituted of electrostatic patterns on the photoconductive drum 4*d*. Then, the developing device 4*g* adheres yellow toner supplied from the toner bottle 2*a*Y to the electrostatic latent image formed on the photoconductive drum 4*d*, thereby developing the electrostatic latent image with the yellow toner into a visible yellow toner image. The yellow toner image is primarily transferred onto the transfer device 5. Thereafter, the cleaning blade 4*b* removes residual toner, which failed to be transferred onto the transfer device 5 and therefore remaining on the photoconductive drum 4*d*, from the photoconductive drum 4*d*, rendering the photoconductive drum 4*d* to be ready for a next primary transfer. Finally, the discharging process is performed to remove residual static electricity from the photoconductive drum 4*d*.

The photoconductive drum 4*d* is a tube including a surface photoconductive layer made of organic and inorganic photoconductors. The charging roller 4*r* is disposed in proximity to the photoconductive drum 4*d* to charge the photoconductive drum 4*d* with discharge between the charging roller 4*r* and the photoconductive drum 4*d*.

The developing device 4*g* includes a supply section for supplying yellow toner to the photoconductive drum 4*d* and a developing section for adhering yellow toner to the photoconductive drum 4*d*. The cleaning blade 4*b* includes an elastic band made of, e.g., rubber, and a toner remover such as a brush. The removable developing device 4*g* is mounted in the housing 2.

Each of the sub-process units 4C, 4M, and 4Bk has a configuration equivalent to the configuration of the sub-process unit 4Y described above. Specifically, the sub-process units 4C, 4M, and 4Bk form toner images of cyan, magenta, and black to be primarily transferred onto the transfer device 5, respectively.

The transfer device 5 includes a transfer belt 5*a*, a driving roller 5*b*, a driven roller 5*c*, four primary transfer rollers 5*d*, and a secondary transfer roller 5*e*. The transfer belt 5*a* is an endless belt entrained around the driving roller 5*b* and the driven roller 5*c*. As the driving roller 5*b* and the driven roller 5*c* rotates, the transfer belt 5*a* rotates, or moves in cycles, in a rotational direction A1.

The four primary transfer rollers 5*d* are primary transfer rollers 5*d*Y, 5*d*C, 5*d*M, and 5*d*Bk pressed against the photoconductive drums 4*d* of the sub-process units 4Y, 4C, 4M, and 4Bk via the transfer belt 5*a*, respectively. Thus, the transfer belt 5*a* contacts the sub-process units 4Y, 4C, 4M, and 4Bk, forming four areas of contact, herein called primary transfer nips, between the transfer belt 5*a* and the sub-process units 4Y, 4C, 4M, and 4Bk, respectively. The secondary transfer roller 5*e* presses an outer circumferential surface of the transfer belt 5*a*, thereby pressing against the driving roller 5*b* via the transfer belt 5*a*. Thus, an area of contact, herein called a secondary transfer nip, is formed between the secondary transfer roller 5*e* and the transfer belt 5*a*.

The belt cleaning device 6 is disposed between the secondary transfer nip and the sub-process unit 4Y in the rotational direction A1 of the transfer belt 5*a*. The belt cleaning device 6 includes a toner remover and the toner conveyance tube. The toner remover removes residual toner, which failed to be transferred onto the sheet S at the secondary transfer nip and therefore remaining on the outer circumferential surface of the transfer belt 5*a*, from the transfer belt 5*a*. The residual toner thus removed is conveyed as waste toner through the toner conveyance tube to the waste toner container.

The sheet feeding device 7 is disposed in a lower portion of the housing 2. The sheet feeding device 7 includes a sheet tray 7*a* and a sheet feeding roller 7*b*. The sheet tray 7*a* holds a plurality of sheets S. The sheet feeding roller 7*b* picks up an uppermost sheet S from the plurality of sheets S on the sheet tray 7*a*, and feeds the uppermost sheet S to the conveyance passage R.

The sheet ejection unit 8 is disposed above the optical writing device 3 and atop the housing 2. The sheet ejection unit 8 includes a sheet ejection tray 8*a* and a sheet ejection roller pair 8*b*. The sheet ejection roller pair 8*b* ejects a sheet S bearing an image onto the sheet ejection tray 8*a*. Thus, the sheets S ejected from the conveyance passage R by the sheet ejection roller pair 8*b* rest one atop another on the sheet ejection tray 8*a*.

The registration roller pair 9 adjusts conveyance of the sheet S along the conveyance passage R, after the sheet S is fed by the sheet feeding roller 7*b* of the sheet feeding device 7.

For example, a registration sensor is interposed between the sheet feeding roller 7*b* and the registration roller pair 9 on the conveyance passage R inside the housing 2 to detect a leading edge of the sheet S conveyed along the conveyance passage R. When a predetermined time elapses after the registration sensor detects the leading edge of the sheet S, the registration roller pair 9 interrupts rotation to temporarily halt the sheet S that comes into contact with the registration roller pair 9. The registration roller pair 9 is timed to resume rotation while sandwiching the sheet S to convey the sheet S to the secondary transfer nip. For example, the registration roller pair 9 resumes rotation in synchronization with a composite color toner image, constituted of the toner images of yellow, cyan, magenta, and black superimposed one atop another on the transfer belt 5*a*, reaching the secondary transfer nip as the transfer belt 5*a* rotates in the rotation direction A1.

After the composite color toner image is transferred from the transfer belt 5*a* to the sheet S at the secondary transfer nip, the sheet S is conveyed to the fixing device 10. The fixing device 10 includes, e.g., a rotatable fixing belt 21 and a pressure roller 22 pressing against an outer circumferential surface of the fixing belt 21. The toner image is fixed onto the sheet S under heat and pressure while the sheet S is conveyed through an area of contact, herein called a fixing nip N, between the fixing belt 21 and the pressure roller 22. As the sheet S bearing the fixed toner image is discharged from the fixing nip N, the sheet S separates from the fixing belt 21 and is conveyed to the sheet ejection roller pair 8*b* along the conveyance passage R.

Figure 2:
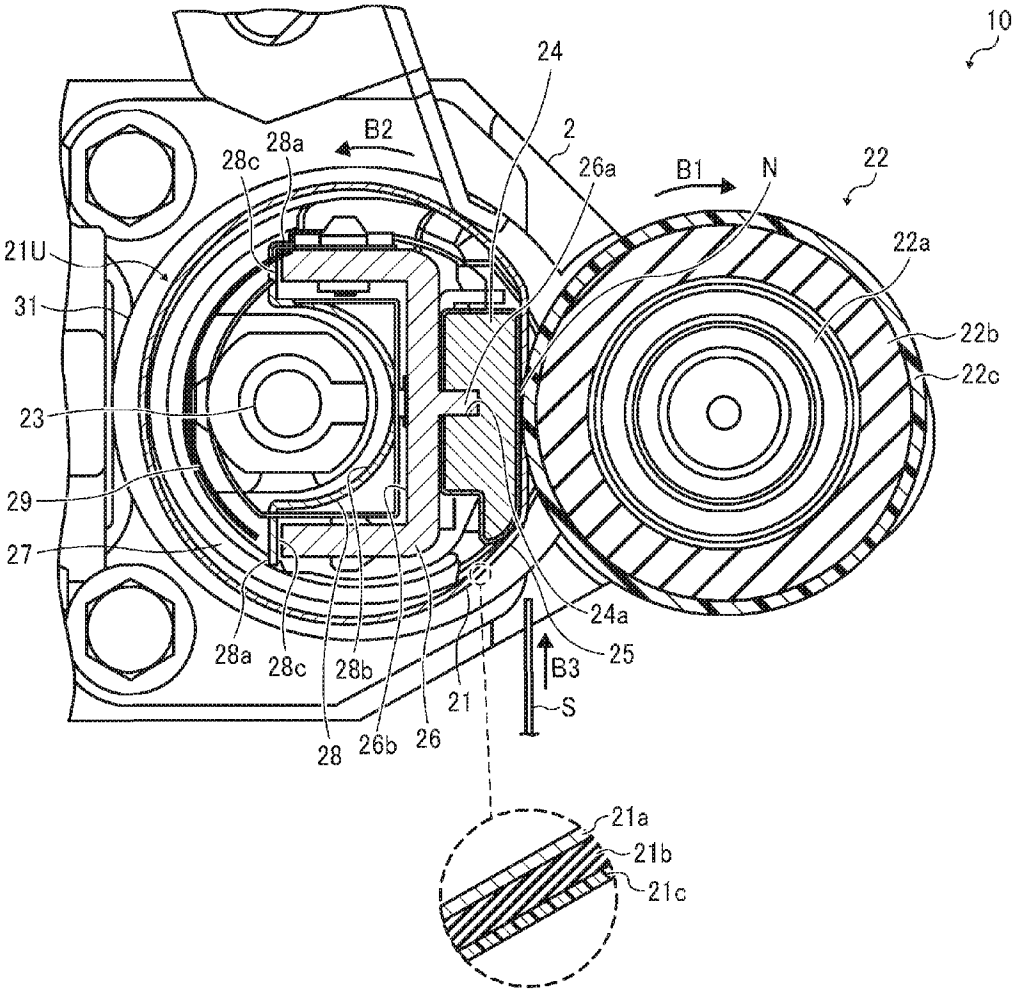
FIG. 2 is a schematic cross-sectional view of a fixing device incorporated in the image forming apparatus of FIG. 1.
Figure 3:
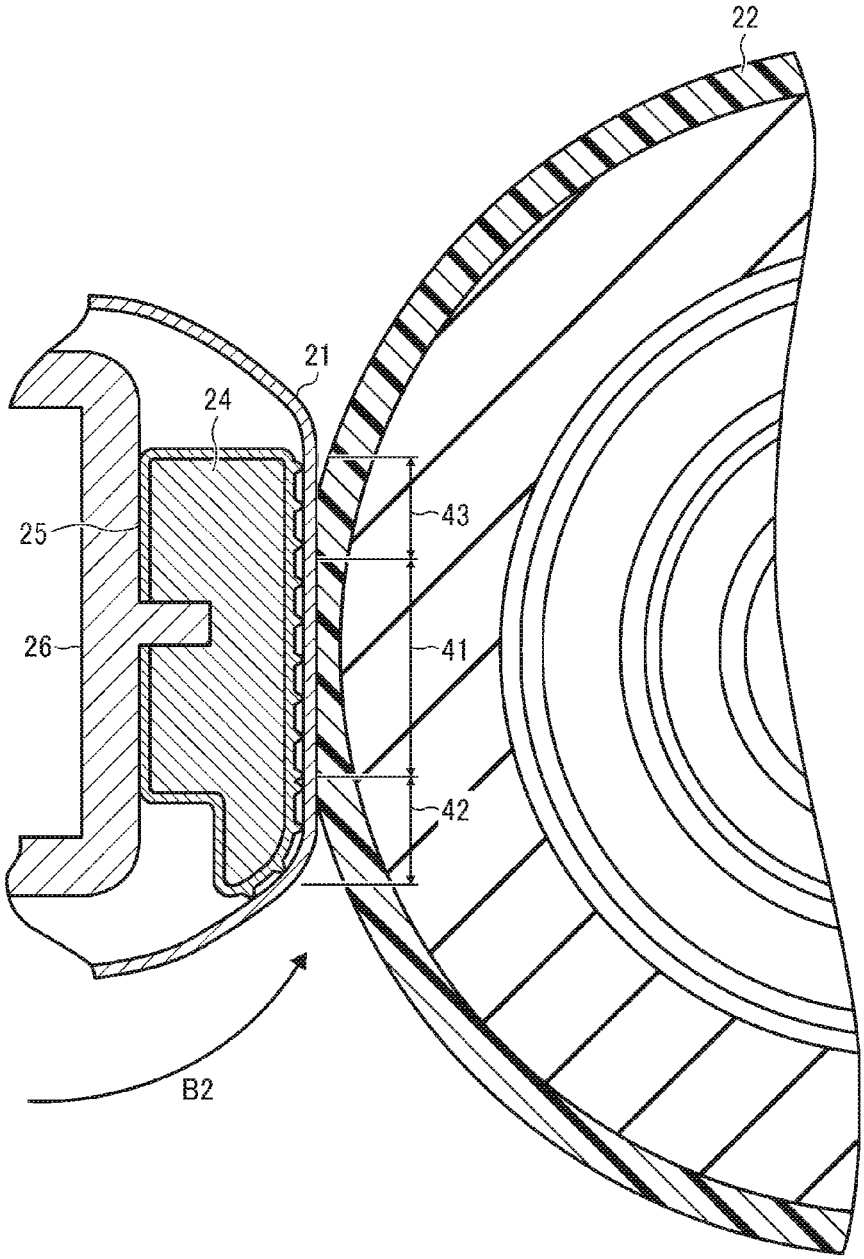
FIG. 3 is a partially enlarged cross-sectional view of the fixing device of FIG. 2, particularly illustrating a slide member together with a nip formation pad and a fixing belt.

Referring now to FIGS. 2 and 3, a detailed description is given of the fixing device 10 incorporated in the image forming apparatus 1 described above.

FIG. 2 is a schematic cross-sectional view of the fixing device 10. FIG. 3 is a partially enlarged cross-sectional view of the fixing device 10 of FIG. 2.

As illustrated in FIG. 2, the fixing device 10 includes the fixing belt 21 as a fixing rotator, the pressure roller 22 as a pressure rotator, a heater 23, a nip formation pad 24, a slide member 25, a support member 26, a holder 27, a reflector 28, a light shield 29, and a belt protector 31. The fixing device 10 includes a controller to control temperature of various components, such as a fixing temperature on the fixing belt 21. The fixing belt 21 and the components disposed inside a loop formed by the fixing belt 21, that is, the heater 23, the nip formation pad 24, the slide member 25, the support member 26, the holder 27, the reflector 28, and the light shield 29, may constitute a belt unit 21U detachably coupled to the pressure roller 22.

The fixing belt 21 is constructed of a base layer 21*a*, an elastic layer 21*b* coating an outer circumferential surface of the base layer 21*a*, and a release layer 21*c* coating an outer circumferential surface of the elastic layer 21*b*. The fixing belt 21 is a flexible belt having a thickness of about 1 mm. The fixing belt 21 is elongated in a width direction of the sheet S conveyed over the outer circumferential surface of the fixing belt 21. The fixing belt 21 is formed into a loop having a diameter of about 25 mm in cross-section perpendicular to the width direction of the sheet S.

It is to be noted that, alternatively, the fixing belt 21 may exclude the elastic layer 21*b*. In such a case, the fixing belt 21 has a decreased thermal capacity that enhances heat conduction, saving energy. The diameter of the fixing belt 21 is selected within a range of from about 15 mm to about 120 mm according to the dimensions of the fixing device 10.

The fixing belt 21 rotates in a rotational direction B2 in accordance with rotation of the pressure roller 22 in a rotational direction B1. In short, the fixing belt 21 is driven by the pressure roller 22. The fixing belt 21 and the pressure roller 22 rotate, thereby conveying the sheet S entering the fixing nip N in a sheet conveyance direction B3, and discharging the sheet S from the fixing nip N. The sheet conveyance direction B3 serves as a recording medium conveyance direction.

The base layer 21*a* is made of a material having a desired mechanical strength, for example, metal material such as nickel (Ni) and stainless steel (SUS), or resin material such as polyimide. The base layer 21*a* is made of metal or resin film having a thickness in a range of from about 20 μm to about 100 μm.

The elastic layer 21*b*, having a thickness in a range of from about 20 μm to about 900 μm, is made of a rubber material such as silicone rubber (Q) and fluoro rubber (FKM). Even if the sheet S and the fixing belt 21 have surface asperities, the elastic layer 21*b* levels pressure exerted on the sheet S and heat conducted from the fixing belt 21 to the sheet S as the fixing belt 21 and the pressure roller 22 apply heat and pressure to the sheet S passing through the fixing nip N. Specifically, as the fixing belt 21 and the pressure roller 22 sandwich and press the toner image on the sheet S passing through the fixing nip N to fix the toner image on the sheet S, slight surface asperities of the fixing belt 21 may be transferred onto the toner image on the sheet S. As a result, a solid portion of the toner image may have uneven gloss, causing the fixed toner image to appear as an orange peel image. However, if the elastic layer 21*b* has a thickness not smaller than about 100 μm, for example, the elastic layer 21*b* deforms to absorb such slight surface asperities, thereby preventing formation of the orange peel image.

The release layer 21*c* is made of a material exhibiting enhanced releasability. Specifically, the release layer 21*c* is made of a material that facilitates separation of the sheet S and the toner image on the sheet S from the fixing belt 21, preventing toner of the toner image from adhering or sticking to the fixing belt 21. Such a material does not adhere or stick to a surface of a mold. For example, the release layer 21*c* is made of resin such as tetrafluoroethylene-perfluoroalkyl vinyl ether copolymer (PFA), polytetrafluoroethylene (PTFE), polyetherimide (PEI), and polyethersulphone (PES). The release layer 21*c* has a thickness in a range of from about 1 μm to about 200 μm.

The pressure roller 22 is constructed of a roller 22*a* as a cored bar, an elastic layer 22*b* coating an outer circumferential surface of the roller 22*a*, and a release layer 22*c* coating an outer circumferential surface of the elastic layer 22*b*. A driver, disposed inside the housing 2, outputs a driving force to rotate the pressure roller 22. The driver is constructed of, e.g., a driving section such as a motor, and a reduction section such as a reduction gear. A biasing assembly presses the pressure roller 22 against the fixing belt 21. At this time, the elastic layer 22*b* of the pressure roller 22 is pressed and elastically deformed to define a part of the fixing nip N.

The roller 22*a* is made of a material having a desired mechanical strength and exhibiting an enhanced thermal conductivity. Specifically, the roller 22*a* is made of metal such as carbon steel and aluminum (Al), and formed as a solid bar. The carbon steel may include, e.g., carbon steel for machine structural use or a carbon steel bar for general structural purpose. Alternatively, the roller 22*a* may be formed as a hollow cylinder inside which a heat source such as a halogen heater is situated. Thus, the heat source heats the sheet S passing through the fixing nip N via the roller 22*a*, the elastic layer 22*b*, and the release layer 22*c* of the pressure roller 22.

Similar to the elastic layer 21*b* of the fixing belt 21, the elastic layer 22*b* of the pressure roller 22 is made of synthetic rubber such as silicone rubber (Q) and fluoro rubber (FKM). The synthetic rubber is relatively rigid, non-foamed solid rubber. If no heat source is disposed inside the roller 22*a*, the elastic layer 22*b* of the pressure roller 22 may be made of sponge rubber including an elastic foam layer. The sponge rubber, as it contains cells, exhibits an enhanced insulation that suppresses heat conduction from the fixing belt 21 to the pressure roller 22. That is, the pressure roller 22 does not draw heat from the fixing belt 21, thereby enhancing energy efficiency.

Similar to the release layer 21*c* of the fixing belt 21, the release layer 22*c* of the pressure roller 22 is made of a material exhibiting an enhanced releasability while enhancing durability of the elastic layer 22*b*, and exhibiting enhanced thermal conductivity and durability. For example, the release layer 22*c* is coating of fluoroplastic made of PEI, PFA, or PTFE. Alternatively, the release layer 22*c* may be formed in a silicone rubber layer or a fluoro rubber layer.

The heater 23 is secured to the housing 2 inside the loop formed by the fixing belt 21, that is, on an inner circumferential side of the fixing belt 21, isolated from the fixing belt 21. The heater 23 includes a heat source having a single heating span to heat the fixing belt 21 directly with radiation heat. The heat source is a radiant heater such as a halogen heater including a halogen lamp that heats the fixing belt 21 directly, a carbon heater including a quartz tube manufactured by filling inert gas with carbon fiber, or a ceramic heater constructed of resistant wiring embedded in ceramic. The controller described above controls power supply to the heater 23.

Alternatively, the heater 23 may include another heat source other than the heat source having a single heating span. For example, the heater 23 may include an induction heater that heats the fixing belt 21 by electromagnetic induction. The induction heater may include an excitation device disposed on an outer circumferential side of the fixing belt 21 and constructed of an excitation coil and a ferrite core. The induction heater may also include a control unit to control the excitation device and an opposite core, disposed inside the loop formed by the fixing belt 21, facing the core via the fixing belt 21.

In such an induction heater, the control unit supplies a high-frequency alternating current to the excitation coil, forming an alternating magnetic field around the excitation coil. Thus, eddy currents are generated on the base layer 21*a*, which is made of metal, of the fixing belt 21. When the eddy currents are generated, the electric resistance of the base layer 21*a* leads to Joule heating. Thus, the base layer 21*a* generates heat by mutual induction heating, as a heat generation layer.

Preferably, for example, the heat generation layer has a thickness of about 10 μm and is made of copper, which leads to a relatively high efficiency. The entire base layer 21*a* is heated by the Joule heating. In the fixing device 10 including such an induction heater, a fixing temperature, which is a surface temperature of the fixing belt 21, increases to a desired temperature with less energy and a shorter startup time.

The nip formation pad 24 is made of a material exhibiting enhanced rigidity. The nip formation pad 24 is elongated in the width direction of the sheet S passing through the fixing nip N illustrated in FIGS. 2 and 3. The nip formation pad 24 has a substantially rectangular cross-section perpendicular to the width direction of the sheet S. The nip formation pad 24 is disposed inside the loop formed by the fixing belt 21 and opposite the pressure roller 22 to form the fixing nip N between the fixing belt 21 and the pressure roller 22.

In the present embodiment, the fixing nip N is planar in cross-section. Alternatively, the fixing nip N may be concave or curved in cross-section with respect to the pressure roller 22. If the fixing nip N is concave, the concave fixing nip N directs a leading edge of the sheet S toward the pressure roller 22, facilitating separation of the sheet S from the fixing nip N and therefore preventing the sheet S from being jammed between the fixing belt 21 and the pressure roller 22. The slide member 25 adjoins an outer circumferential surface of the nip formation pad 24. The nip formation pad 24 includes a joint 24*a* that adjoins the support member 26. Thus, the nip formation pad 24 is secured to the housing 2 of the image forming apparatus 1 via the joint 24*a*.

Typical fixing devices may incorporate a fixing belt that is directly heated by a heater and has a groove portion and a rough portion on an inner circumferential surface of the fixing belt, and a lubricant applier that applies lubricant on the inner circumferential surface of the fixing belt.

In such a typical fixing device, for example, the fixing belt is interposed between a fixing roller including a halogen heater inside and a pressure pad including a low-friction sheet on an outer circumferential surface of the pressure pad. As the fixing roller rotates, the fixing belt rotates. The groove portion of the fixing belt is formed in a rotating direction of the fixing belt. The rough portion is irregularly formed by sandblasting.

Since the fixing belt contacts the low-friction sheet while rotating, a sliding friction is generated between the fixing belt and the low-friction sheet. However, the fixing belt keeps the sliding friction relatively low because the fixing belt retains the lubricant applied by the lubricant applier at the groove portion and the rough portion. Accordingly, the fixing belt may have an increased durability. As a result, the recording media may be conveyed through the fixing belt and the fixing roller stably for a long period of time, preventing wrinkles on the recording media and image skews.

However, in such a typical fixing device, the groove portion and the rough portion of the fixing belt slide on the outer circumferential surface of the low-friction sheet, thereby speeding attrition of the low-friction sheet and decreasing the durability of the low-friction sheet. In addition, the lubricant applied to the groove portion and the rough portion flows in a width direction of the fixing belt, which is perpendicular to the conveyance direction of the recording media, and leaks from an end in the width direction of the fixing belt. Such leakage of the lubricant may damage the fixing device and increase a torque due to shortage of the lubricant.

Hence, in the present embodiment, the fixing device 10 incorporates the slide member 25 applied with lubricant to allow a smooth sliding of the fixing belt 21 on the slide member 25. The slide member 25 is made of a material exhibiting enhanced mechanical strength in view of resistance to abrasion, heat, coefficient of friction, and the like. For example, the slide member 25 is made of resin such as PFA and PTFE. The slide member 25 is a sheet having a thickness in a range of from about 50 μm to about 2,500 μm. As illustrated in FIG. 3, the slide member 25 adheres to the outer circumferential surface of the nip formation pad 24. Thus, the slide member 25 is disposed between the fixing belt 21 and the nip formation pad 24. Alternatively, the slide member 25 may be a film, made of resin such as PFA and PTFE, coating the outer circumferential surface of the nip formation pad 24 with a predetermined thickness.

The slide member 25 has a pressure surface 41 pressed by the pressure roller 22, and non-pressure surfaces 42 and 43. The pressure surface 41 and the fixing belt 21 defines the fixing nip N.

Referring now to FIGS. 4A through 4E, a description is given of a first comparative slide member 125.

Figure 4A:
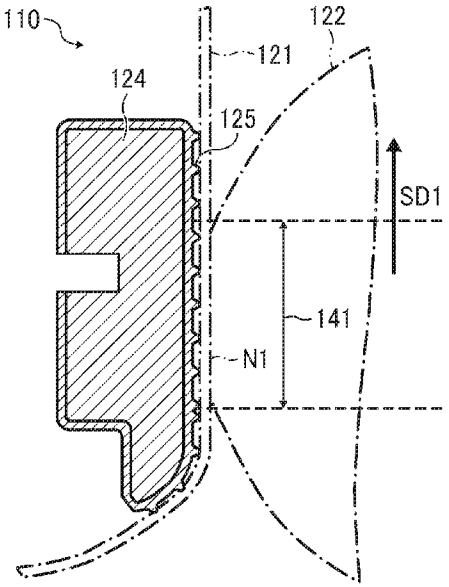
FIG. 4A is a partial cross-sectional view of a first comparative fixing device, illustrating a first comparative slide member together with a nip formation pad.
Figure 4B:
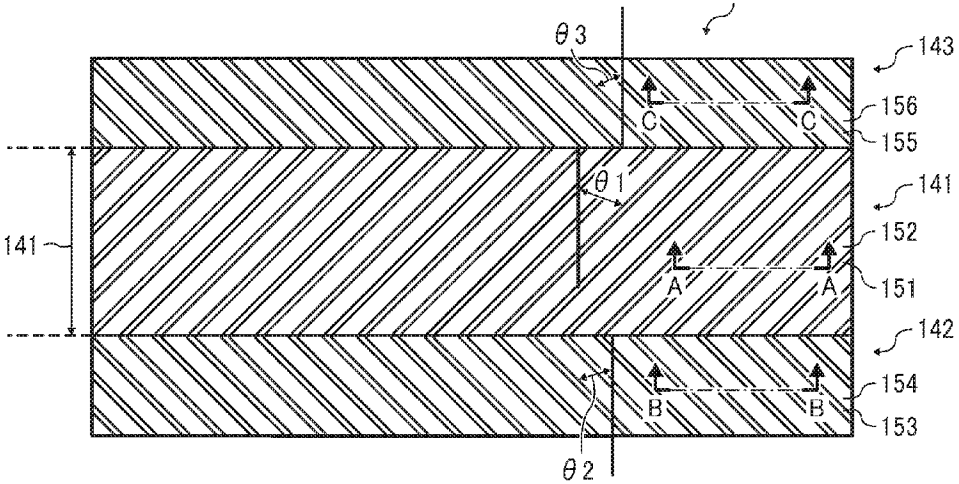
FIG. 4B is a front view of the first comparative slide member of FIG. 4A.
Figure 4C:
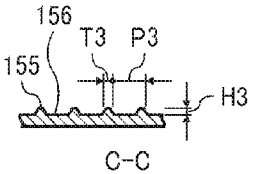
FIG. 4C is a cross-sectional view of the first comparative slide member along a line C-C of FIG. 4A.
Figure 4D:
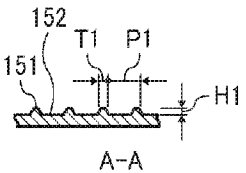
FIG. 4D is a cross-sectional view of the first comparative slide member along a line A-A of FIG. 4A.
Figure 4E:
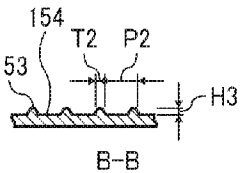
FIG. 4E is a cross-sectional view of the first comparative slide member along a line B-B of FIG. 4A.

FIG. 4A is a partial cross-sectional view of a first comparative fixing device 110, illustrating the first comparative slide member 125 together with a nip formation pad 124 that forms a fixing nip NI. FIG. 4B is a front view of the first comparative slide member 125. FIG. 4C is a cross-sectional view of the first comparative slide member 125 along a line C-C. FIG. 4D is a cross-sectional view of the first comparative slide member 125 along a line A-A. FIG. 4E is a cross-sectional view of the first comparative slide member 125 along a line B-B.

As illustrated in FIGS. 4B and 4D, a pressure surface 141 has a plurality of projections 151. The plurality of projections 151 project toward a pressure roller 122 from the pressure surface 141 while inclining at an angle θ1 with respect to a sliding direction SD1 of a fixing belt 121 illustrated in FIG. 4A. The plurality of projections 151 define a slant groove 152 as a first slant groove. Each of the plurality of projections 151 has a thickness T1 and a height H1 in a projecting direction of the projection 151 from the pressure surface 141. The plurality of projections 151 are aligned at intervals P1 in a width direction perpendicular to the sliding direction SD1 of the fixing belt 121. The pressure roller 122 presses a substantially entire area of the pressure surface 141 via the fixing belt 121. In other words, the pressure surface 141 is a pressure area, against which the pressure roller 122 presses.

Similar to the pressure surface 141, a non-pressure surface 142 has a plurality of projections 153 as illustrated in FIGS. 4B and 4E. The plurality of projections 153 project toward the pressure roller 122 from the non-pressure surface 142 while inclining at an angle θ2 in a direction opposite to the sliding direction SD1 of the fixing belt 121. The plurality of projections 153 define a slant groove 154 as a second slant groove. Similar to the projection 151, each of the plurality of projections 153 has a thickness T2 and a height H2 in a projecting direction of the projection 153 from the non-pressure surface 142. The plurality of projections 153 are aligned at intervals P2 in the width direction perpendicular to the sliding direction SD1 of the fixing belt 121.

Similar to the non-pressure surface 142, the non-pressure surface 143 has a plurality of projections 155 as illustrated in FIGS. 4B and 4C. The plurality of projections 155 project toward the pressure roller 122 from the non-pressure surface 143 while inclining at an angle θ3 in a direction opposite to a direction defined by the angle θ1. The plurality of projections 155 define a slant groove 156 as a second slant groove. Similar to the projection 151, each of the plurality of projections 155 has a thickness T3 and a height H3 in a projecting direction of the projection 155 from the non-pressure surface 143. The plurality of projections 155 are aligned at intervals P3 in the width direction perpendicular to the sliding direction SD1 of the fixing belt 121.

Lubricant is applied inside the slant grooves 152, 154, and 156 to allow a smooth sliding of the fixing belt 121 on the first comparative slide member 125. The lubricant is, e.g., silicone oil or fluorine grease.

The material and thickness of the first comparative slide member 125 are selected according to dimensions of the first comparative fixing device 110. The heights H1 to H3 and the thickness T1 to T3 of the projections 151, 153 and 155, and the intervals P1 to P3 at which the projections 151, 153 and 155 are aligned are also selected according to dimensions of the first comparative fixing device 110. Preferably the projections 151, 153 and 155 have identical heights and thickness, and are aligned at identical intervals. However, the projections 151, 153 and 155 may have different heights and thickness, and may be aligned at different intervals.

The non-pressure surfaces 142 and 143 are not pressed by the pressure roller 122. On the other hand, the inner circumferential surface of the fixing belt 121 contacts the non-pressure surfaces 142 and 143 substantially when the fixing belt 121 travels, thereby defining sliding areas in the non-pressure surfaces 142 and 143 on which the fixing belt 121 slides. The projections 151 and 153 are formed such that a boundary between the slant groove 152 and the slant groove 154 is within an area of the non-pressure surface 142. Similarly, the projections 151 and 155 are formed such that a boundary between the slant groove 152 and the slant groove 156 is within an area of the non-pressure surface 143.

Alternatively, another structure other than the plurality of projections 151, 153 and 155 may define the slant groove 152 formed on the pressure surface 141 and the slant grooves 154 and 156 respectively formed on the non-pressure surfaces 142 and 143.

Figure 5B:
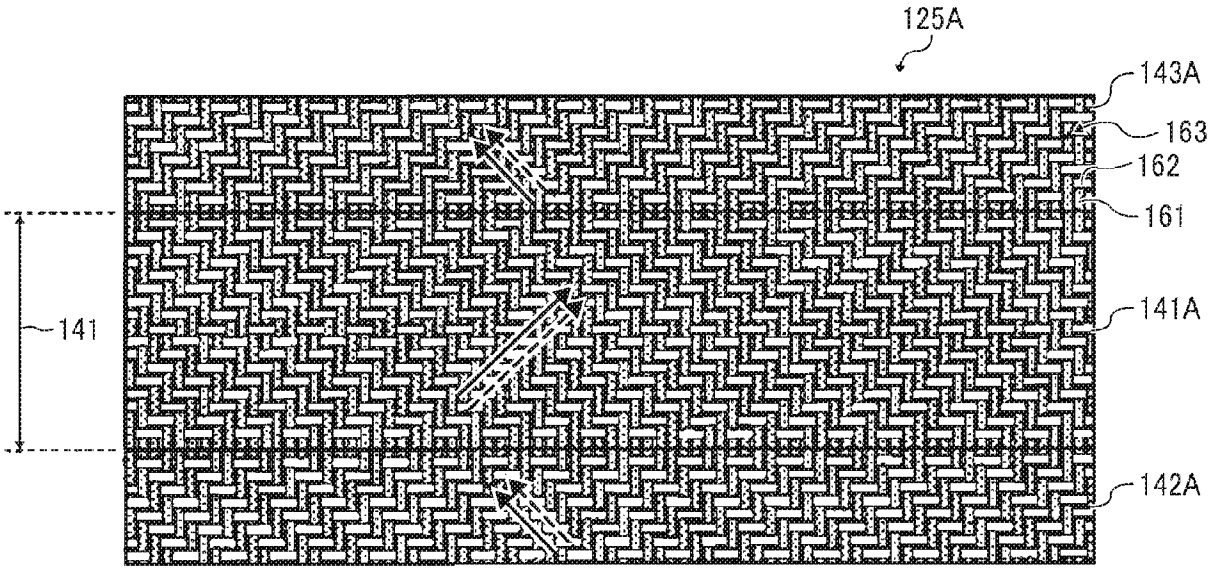
FIG. 5B is a front view of the second comparative slide member of FIG. 5A.
Figure 5A:
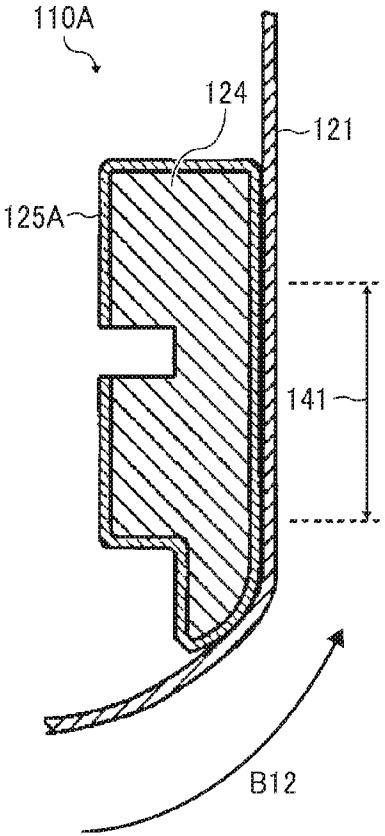
FIG. 5A is a partial cross-sectional view of a second comparative fixing device, illustrating a second comparative slide member together with a nip formation pad and a fixing belt.

Referring now to FIGS. 5A and 5B, a description is given of a second comparative slide member 125A.

FIG. 5A is a partial cross-sectional view of a second comparative fixing device 110A, illustrating the second comparative slide member 125A together with the nip formation pad 124 and the fixing belt 121. FIG. 5B is a front view of the second comparative slide member 125A.

The second comparative slide member 125A includes a twilled fabric 163, in which longitudinal threads or warp 161 and lateral threads or woof 162 are interwoven, producing a pattern of diagonal parallel ribs. Similar to the slide member 25, the second comparative slide member 125A including the twilled fabric 163 is made of a material exhibiting enhanced mechanical strength in view of resistance to abrasion, heat, friction, and the like. For example, the second comparative slide member 125A is made of resin such as PFA and PTFE. The second comparative slide member 125A includes a pressure surface 141A, and non-pressure surfaces 142A and 143A. In the second comparative slide member 125A, each of the warp 161 and the woof 162 has a projecting portion floating across the other. A neighborhood of the warp 161 woven under the woof 162 serves as a first slant groove. Similarly, a neighborhood of the woof 162 woven under the warp 161 serves as a second slant groove.

As described above, the twilled fabric 163 has the projecting portions made by the warp 161 and the woof 162 woven over the other, forming ribs inclining at about 45 degrees in the sliding direction SD1 of the fixing belt 121, indicated by broken arrows and solid arrows in FIG. 5B. By contrast, the neighborhood of the warp 161 and the woof 162 woven under the other, that is, the neighborhood of the ribs are groove portions inclining at about 45 degrees in a direction opposite the direction in which the ribs incline as described above. The tops of the ribs contacts the inner circumferential surface of the fixing belt 121, which rotates in a rotational direction B12. Lubricant is applied inside the groove portions.

A total area of the sliding areas of the non-pressure surfaces 142 and 143 is greater than the pressure area in the pressure surface 141.

Referring back to FIG. 2, similar to the nip formation pad 24, the support member 26 is elongated in the width direction of the sheet S. The support member 26 is formed in a groove opening toward the heater 23 in cross-section perpendicular to the width direction of the sheet S. The support member 26 includes a support portion 26*a* supporting the nip formation pad 24 and a holding portion 26*b* holding the heater 23 and the reflector 28. The support portion 26*a* of the support member 26 adjoins the joint 24*a* of the nip formation pad 24 to support the nip formation pad 24 against pressure from the pressure roller 22, preventing the nip formation pad 24 from being bent in the width direction of the sheet S. Thus, the nip formation pad 24 retains the length of the fixing nip N that is even throughout the entire width of the sheet S. Similar to the nip formation pad 24, the support member 26 is disposed inside the loop formed by the fixing belt 21 and secured to the housing 2 of the image forming apparatus 1.

The holder 27 is disposed so as to enter an inner circumferential side of opposed ends of the fixing belt 21 and secured to the housing 2 of the image forming apparatus 1. The holder 27 holds both lateral ends of the support member 26 in the width direction of the sheet S and positions the support member 26 with respect to the housing 2 of the image forming apparatus 1. Additionally, the holder 27 guides both lateral ends of the fixing belt 21 in the width direction of the sheet S, preventing the fixing bell 21 from being skewed in the width direction of the sheet S as the fixing belt 21 rotates.

The reflector 28 includes a secured portion 28*a*, a reflection face 28*b*, and a cover portion 28*c*. The secured portion 28*a* is secured to the housing 2 of the image forming apparatus 1. The reflection face 28*b* reflects light emitted from the heater 23 toward the inner circumferential surface of the fixing belt 21. The cover portion 28*c* covers the support member 26. Specifically, the secured portion 28*a* is disposed at each lateral end of the reflector 28 in the width direction of the sheet S. Thus, the reflector 28 is secured to the housing 2 of the image forming apparatus 1 at the secured portions 28*a*. The reflection face 28*b* is interposed between the support member 26 and the heater 23. The reflection face 28*b* has a curving portion facing the heater 23 and encompassing the heater 23.

The cover portion 28*c* covers a substantially entire opening of the support member 26 in the width direction of the sheet S, on an opposite side of the support portion 26*a* of the support member 26. The reflector 28 reflects light or heat radiated from the heater 23 to the fixing belt 21 effectively, thereby suppressing conduction of radiation heat from the heater 23 to the support member 26. Thus, the reflector 28 enhances energy efficiency. Alternatively, instead of using the reflector 28, an inner circumferential surface of the holding portion 26*b* of the support member 26 may be given a mirror finish to reflect light radiated from the heater 23 toward the fixing belt 21 and to enhance energy efficiency. Yet alternatively, the inner circumferential side of the holding portion 26*b* of the support member 26 may be made of a heat insulator to prevent transmission of heat from the heater 23 to the support member 26, thereby enhancing energy efficiency.

Figure 6:
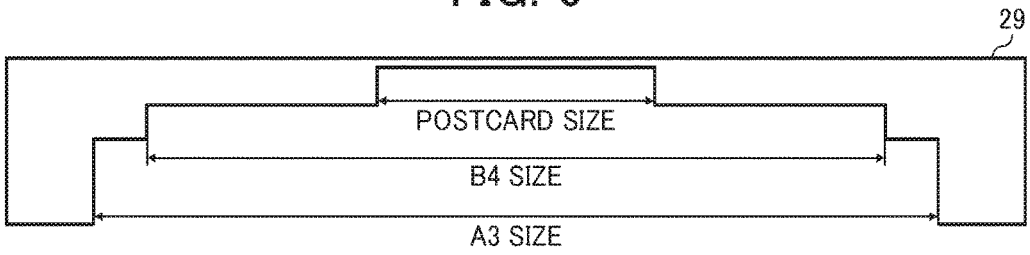
FIG. 6 is a schematic view of a shield for the fixing belt incorporated in the fixing device of FIG. 2.

The light shield 29 shields the fixing belt 21 from the light emitted from the heater 23 according to the size of the sheet S. As specifically illustrated in FIG. 6, the light shield 29 has shied portions differing in width on opposed sides of the light shield 29. The light shield 29 has relatively narrow shield portions for A3 size, for example, such that the radiation heat from the heater 23 reaches an A3 sheet S. The light shield 29 also has shield portions for B4 size, for example, wider than the shield portions for A3 size, such that the radiation heat from the heater 23 reaches a B4 sheet S. The light shield 29 also has shield portions for postcard size, for example, wider than the shield portions for B4 size, such that the radiation heat from the heater 23 reaches a sheet S such as a postcard.

The light shield 29 is interposed between the inner circumferential surface of the fixing belt 21 and the heater 23. A guide supports each lateral end of the light shield 29 in the width direction of the sheet S such that the light shield 29 is rotatable about the housing 2 of the image forming apparatus 1. According to the size of the sheet S, the light shield 29 rotates to shield the fixing belt 21 such that the light emitted from the heater 23 reaches a localized portion of the fixing belt 21 corresponding to the size of the sheet S.

Accordingly, even if a plurality of relatively narrow sheets S is conveyed over the fixing belt 21 continuously, a non-conveyance span of the fixing belt 21 where the relatively narrow sheets S are not conveyed does not overheat. Consequently, unproductive control is rendered unnecessary that may degrade productivity of the fixing device 10 to prevent overheating. Additionally, the number of halogen heaters constructing the heater 23 is reduced from three to two, for example, thereby reducing production costs and saving energy.

Referring back to FIG. 2, the belt protector 31 is a disk having a through hole in the center, into which a projecting portion of the holder 27 is inserted. The belt protector 31 is mounted on a base end portion of the holder 27 to regulate movement of the fixing belt 21 in the width direction of the sheet S, together with the base end portion of the holder 27. The belt protector 31 has a planar side face which an end of the fixing belt 21 contacts. Since the fixing belt 21 rotates while contacting the planar side face of the belt protector 31, the belt protector 31 has a smooth surface made of a relatively elastic material having a relatively small coefficient of friction.

Referring back to FIG. 1, a brief description is given of an image forming operation of the image forming apparatus 1 to form a color toner image on a sheet S. As a print job starts, a driver drives and rotates the photoconductive drums 4*d* of the sub-process units 4Y, 4C, 4M, and 4Bk, respectively, in a clockwise direction in FIG. 1. The charging rollers 4*r* uniformly charge the outer circumferential surface of the respective photoconductive drums 4*d* at a predetermined polarity. The optical writing device 3 emits laser beams Lb onto the charged outer circumferential surface of the photoconductive drums 4*d* according to yellow, cyan, magenta, and black image data, respectively, to form electrostatic latent images on the photoconductive drums 4*d*. It is to be noted that the yellow, cyan, magenta, and black image data are single-color image data, into which desired full-color image data is decomposed. The developing devices 4*g* supply toner of yellow, cyan, magenta, and black to the electrostatic latent images formed on the photoconductive drums 4*d*, thereby developing the electrostatic latent images into visible toner images of yellow, cyan, magenta, and black, respectively.

As a driver drives and rotates the driving roller 5*b* in a counterclockwise direction in FIG. 1, the driving roller 5*b* rotates the transfer belt 5*a* in the rotational direction A1. A power supply applies a constant voltage or a constant current control voltage having a polarity opposite a polarity of the charged toner to the primary transfer rollers 5*d*Y, 5*d*C, 5*d*M, and 5*d*Bk, producing a transfer electric field at each primary transfer nip formed between the photoconductive drums 4*d* and the primary transfer rollers 5*d*Y, 5*d*C, 5*d*M, and 5*d*Bk. Accordingly, the toner images of yellow, cyan, magenta, and black formed on the photoconductive drums 4*d* are primarily transferred from the photoconductive drums 4*d* onto the transfer belt 5*a* by the transfer electric fields produced at the primary transfer nips while being superimposed one atop another on the transfer belt 5*a*. Thus, a composite color toner image is formed on the outer circumferential surface of the transfer belt 5*a*.

After the primary transfer of the toner images of yellow, cyan, magenta, and black from the photoconductive drums 4*d* onto the transfer belt 5*a*, the cleaning blades 4*b* remove residual toner, which failed to be transferred onto the transfer belt 5*a* and therefore remaining on the photoconductive drums 4*d*, from the photoconductive drums 4*d*. Thereafter, dischargers discharge the outer circumferential surface of the respective photoconductive drums 4*d*, initializing the surface potential of the respective photoconductive drums 4*d*, and rendering the photoconductive drums 4*d* to be ready for a next print job.

As an image forming operation starts for forming a toner image with the developing devices 4*g* supplying toner to the electrostatic latent images on the photoconductive drums 4*d*, the sheet feeding roller 7*b* situated in the lower portion of the housing 2 starts rotation. The sheet feeding roller 7*b* picks up and feeds an uppermost sheet S of a plurality of sheets S on the sheet tray 7*a* of the sheet feeding device 7 to the conveyance passage R. The registration roller pair 9 is timed to convey the sheet S, thus sent to the conveyance passage R by the sheet feeding roller 7*b*, to the secondary transfer nip formed between the secondary transfer roller 5*e* and the transfer belt 5*a*. The secondary transfer roller 5*e* is applied with a transfer voltage having a polarity opposite a polarity of the toner contained in the composite color toner image formed on the transfer belt 5*a*, producing a transfer electric field at the secondary transfer nip.

The transfer electric field secondarily transfers the toner images of yellow, cyan, magenta, and black constructing the composite color toner image from the transfer belt 5*a* onto the sheet S collectively. The sheet S bearing the composite color toner image is conveyed to the fixing device 10 where the fixing belt 21 and the pressure roller 22 form the fixing nip N. As the sheet S is conveyed through the fixing nip N, the fixing belt 21 applies heat to the sheet S. At the same time, the pressure roller 22 exerts pressure on the sheet S, together with the fixing belt 21. Thus, the composite color toner image is fixed on the sheet S.

Figure 7A:
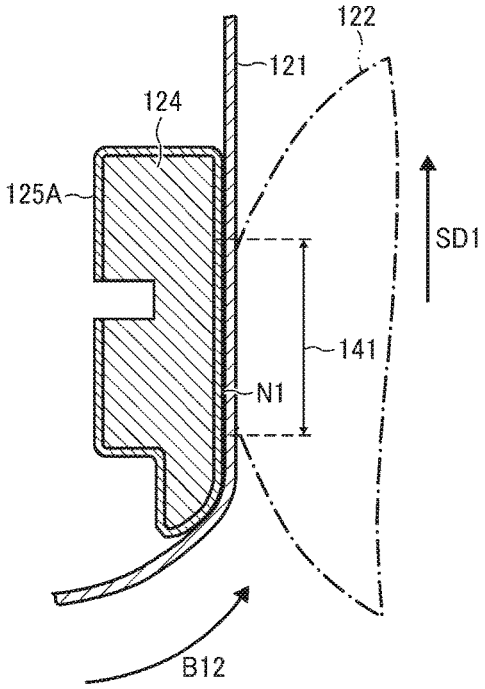
FIG. 7A is a cross-sectional view of the second comparative slide member together with the nip formation pad.
Figure 7B:
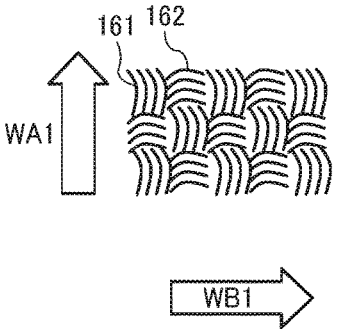
FIG. 7B is a partially enlarged front view of the second comparative slide member of FIG. 7A.

Referring now to FIGS. 7A and 7B, a description is given of the second comparative slide member 125A.

FIG. 7A is a cross-sectional view of the second comparative slide member 125A. FIG. 7B is an enlarged front view of the second comparative slide member 125A.

As specifically illustrated in FIG. 7B, the warp 161 and the woof 162 have identical proportions in the second comparative slide member 125A. For example, the warp 161 as a first strand and the woof 162 as a second strand are identical in the number per unit area. The warp 161 and the woof 162 are interwoven such that the warp 161 and the woof 162 have identical sizes. In such a configuration, the lubricant moves equally in both a warp direction WA1, in which the warp 161 is disposed, and a woof direction WB1, in which the woof 162 is disposed. The lubricant flowing in the woof direction WA1 leaks from an end of the second comparative slide member 125A, thereby reducing the amount of the lubricant remaining in the second comparative slide member 125A. By contrast, a slide member according to an embodiment of the present disclosure reduces friction between the fixing belt and the slide member while preventing leakage of lubricant from the slide member.

Figure 8A:
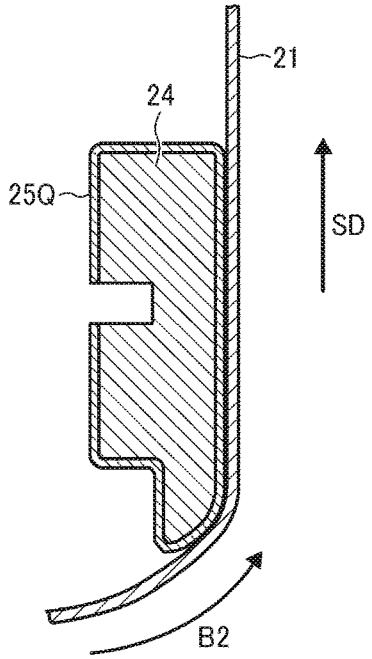
FIG. 8A is a cross-sectional view of a slide member according to a first embodiment of the present disclosure, together with the nip formation pad and the fixing belt.
Figure 8B:
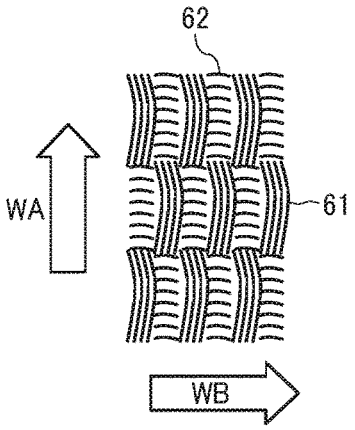
FIG. 8B is a partially enlarged front view of the slide member of FIG. 8A.

Referring now to FIGS. 8A and 8B, a description is given of a slide member 25Q according to a first embodiment of the present disclosure.

FIG. 8A is a cross-sectional view of the slide member 25Q together with the fixing belt 21 and the nip formation pad 24. FIG. 8B is a partially enlarged front view of the slide member 25Q.

Since the fixing belt 21 slides on the slide member 25Q in a sliding direction SD, which is parallel to the rotational direction B2 of the fixing belt 21, lubricant adhering to an inner circumferential surface of the fixing belt 21 also moves in a warp direction WA, in which a set of longitudinal threads or warp 61 is disposed, along the rotational direction B2 of the fixing belt 21. The warp 61 as a set of first strands is disposed parallel to the sliding direction SD of the fixing belt 21. A set of lateral threads or woof 62 as a set of second strands is disposed perpendicular to the sliding direction SD of the fixing belt 21. The warp 61 and the woof 62 are interwoven such that the warp 61 are longer than the woof 62 as illustrated in FIG. 8B. Since the woof 62 applies a reduced biding force to the warp 61, the slide member 25Q may be widen in a woof direction WB in which the woof 62 is disposed. As a consequence, the warp 61 occupies a larger area than the woof 62 in the slide member 25Q, increasing the amount of lubricant remaining in the slide member 25Q. In other words, the warp 61 disposed parallel to the sliding direction SD of the fixing belt 21, in which the lubricant flows at the fixing nip N, is woven over and under the woof 62 disposed perpendicular to the sliding direction SD, so as to hold a larger amount of lubricant than the woof 62 per unit area. The lubricant held by the warp 61 smoothly flows in the sliding direction SD or in the warp direction WA. Therefore, the lubricant is unlikely to flow in the woof direction WB, preventing leakage of the lubricant from the slide member 25Q.

Figure 9A:
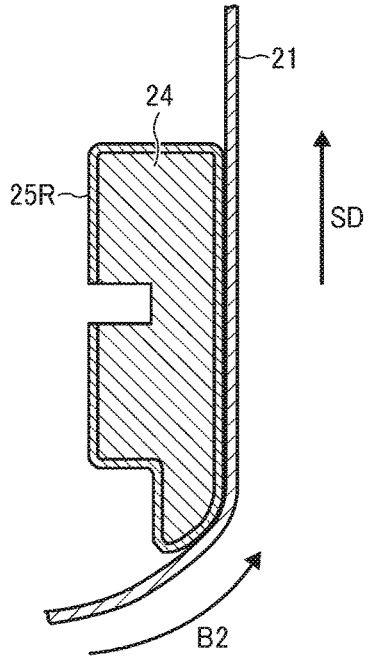
FIG. 9A is a cross-sectional view of a slide member according to a second embodiment of the present disclosure, together with the nip formation pad and the fixing belt.
Figure 9B:
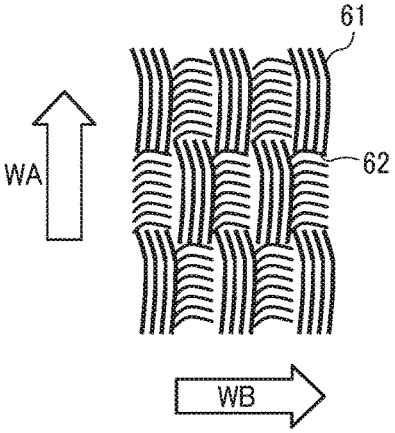
FIG. 9B is a partially enlarged front view of the slide member of FIG. 9A.

Referring now to FIGS. 9A and 9B, a description is given of a slide member 25R according to a second embodiment of the present disclosure.

FIG. 9A is a cross-sectional view of the slide member 25R together with the fixing belt 21 and the nip formation pad 24. FIG. 9B is a partially enlarged front view of the slide member 25R.

The fixing belt 21 slides on the slide member 25R in the sliding direction SD while rotating in the rotational direction B2. At this time, lubricant applied to the slide member 25R flows in the warp direction WA and in the woof direction WB. The warp 61 disposed parallel to the sliding direction SD of the fixing belt 21 is thicker than the woof 62 disposed perpendicular to the sliding direction SD of the fixing belt 21. Therefore, the lubricant remains between the warp 61 and the woof 62, and flows in the warp direction WA along with the fixing belt 21 rotating. On the other hand, an insubstantial amount of lubricant flows in the woof direction WB, preventing leakage of the lubricant from the slide member 25R.

Figure 10A:
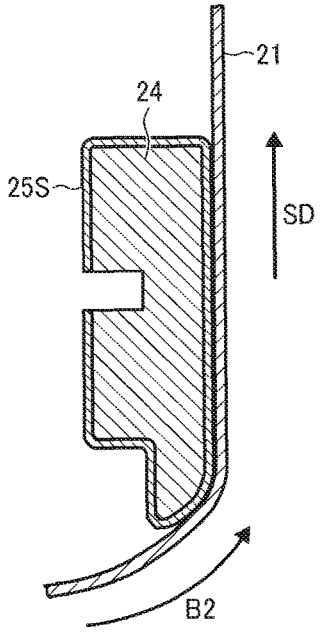
FIG. 10A is a cross-sectional view of a slide member according to a third embodiment of the present disclosure, together with the nip formation pad and the fixing belt.
Figure 10B:
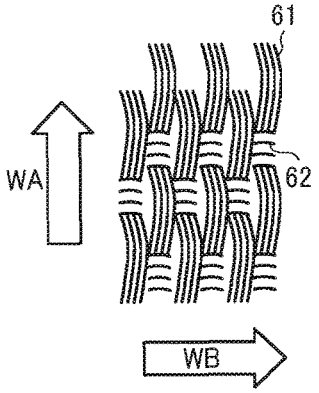
FIG. 10B is a partially enlarged front view of the slide member of FIG. 10A.

Referring now to FIGS. 10A and 10B, a description is given of a slide member 25S according to a third embodiment of the present disclosure.

FIG. 10A is a cross-sectional view of the slide member 25S together with the fixing belt 21 and the nip formation pad 24. FIG. 10B is a partially enlarged front view of the slide member 25S.

The slide member 25S has a greater proportion of the warp 61 disposed parallel to the sliding direction SD of the fixing belt 21 than a proportion of the woof 62 disposed perpendicular to the sliding direction SD of the fixing belt 21. For example, the number of the woof 62 as a second strand is decreased per unit area. In such a configuration, the woof 62 applies a decreased binding force to the warp 61, compared to the binding force applied to the warp 61 in the slide member 25R according to the second embodiment. As a consequence, in the slide member 25S, the warp 61 is unlikely to move in the woof direction WB, enhancing prevention of leakage of lubricant.

Figure 11A:
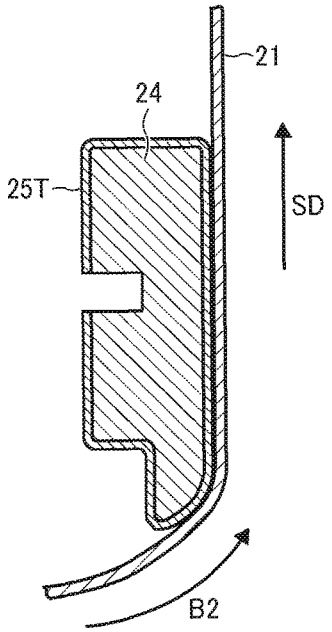
FIG. 11A is a cross-sectional view of a slide member according to a fourth embodiment of the present disclosure, together with the nip formation pad and the fixing belt.
Figure 11B:
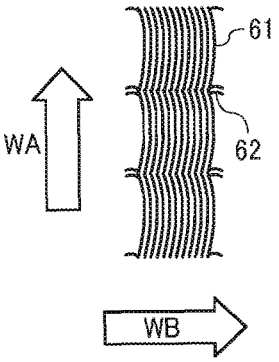
FIG. 11B is a partially enlarged front view of the slide member of FIG. 11A.

Referring now to FIGS. 11A and 11B, a description is given of a slide member 25T according to a fourth embodiment of the present disclosure.

Figure 11C:
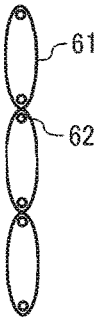
FIG. 11C is a cross-sectional view of the slide member of FIG. 11B.

FIG. 11A is a cross-sectional view of the slide member 25T together with the fixing belt 21 and the nip formation pad 24. FIG. 11B is a partially enlarged front view of the slide member 25T. FIG. 11C is a cross-sectional view of the slide member 25T.

In the slide member 25T, the warp 61 disposed parallel to the sliding direction SD of the fixing belt 21 and the woof 62 disposed perpendicular to the sliding direction SD of the fixing belt 21 are interwoven to produce a warp faced textile. Specifically, only the warp 61 is visible on an outer surface of the slide member 25T, facing the fixing belt 21. In such a configuration, lubricant merely flows in the woof direction WB perpendicular to the sliding direction SD of the fixing belt 21. To increase the strength of the slide member 25T, a plurality of lateral threads (i.e., woof 62) pass over and under vertical threads (i.e., warp 61). For example, the vertical threads are woven to envelop two lateral threads with each stitch in cross section as illustrated in FIG. 11C. Alternatively, the vertical threads may be woven to envelop, in cross section, one lateral thread that is thicker than each vertical thread to increase the strength of the slide member 25T.

Figure 12A:
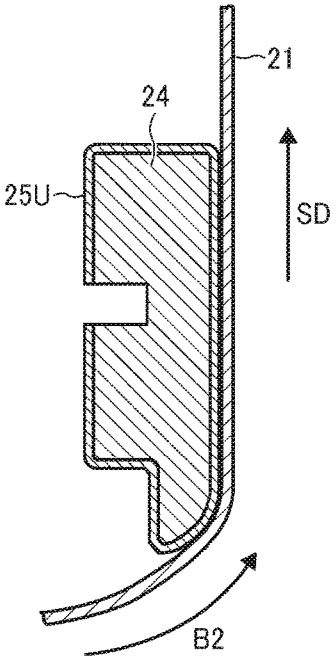
FIG. 12A is a cross-sectional view of a slide member according to a fifth embodiment of the present disclosure, together with the nip formation pad and the fixing belt.
Figure 12B:
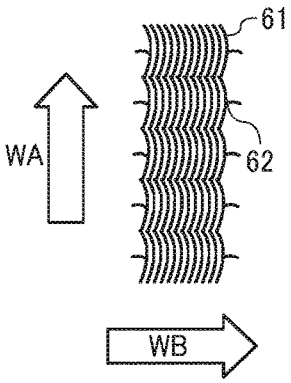
FIG. 12B is a partially enlarged front view of the slide member of FIG. 12A.

Referring now to FIGS. 12A and 12B, a description is given of a slide member 25U according to a fifth embodiment of the present disclosure.

Figure 12C:
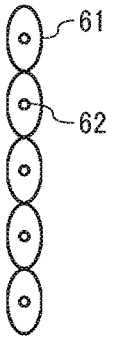
FIG. 12C is a cross-sectional view of the slide member of FIG. 12B.

FIG. 12A is a cross-sectional view of the slide member 25S together with the fixing belt 21 and the nip formation pad 24. FIG. 12B is a partially enlarged front view of the slide member 25U. FIG. 12C is a cross-sectional view of the slide member 25U.

Similar to the slide member 25T, the slide member 25U includes the warp 61, disposed parallel to the sliding direction SD of the fixing belt 21, and the woof 62, disposed perpendicular to the sliding direction SD of the fixing belt 21, interwoven to produce a warp faced textile. In the slide member 25U, however, vertical threads (i.e., warp 61) are woven alternately with respect to one lateral thread (i.e., woof 62) as illustrated in FIG. 12C. In other words, one lateral thread is woven with respect to a stitch or rib portion of the warp 61. Accordingly, production of the slide member 25U is easier than production of the slide member 25T.

The slide members 25T and 25U may have configurations other than the configurations described above, provided that each of the slide members 25T and 25U has a warp faced textile.

Alternatively, the fixing device 10 may incorporate an exemplary slide member 25 according to a combination of one or more of the embodiments described above to allow the warp 61 to hold a greater amount of lubricant than the woof 62 per unit area, while preventing leakage of the lubricant from the slide member 25.

The slide member 25 according to the embodiments of the present disclosure exhibits an enhanced durability compared to the comparative slide members. Thus, the slide member 25 has an increased life span while preventing leakage of lubricant from the slide member 25. Accordingly, even though the fixing device 10 is operated for a relatively long period of time, the slide member 25 prevents an increase in torque and damages to neighboring components of the slide member 25 in the fixing device 10.

The present disclosure has been described above with reference to specific embodiments. It is to be noted that the present disclosure is not limited to the details of the embodiments described above, but various modifications and enhancements are possible without departing from the scope of the present disclosure. It is therefore to be understood that the present disclosure may be practiced otherwise than as specifically described herein. For example, elements and/or features of different embodiments may be combined with each other and/or substituted for each other within the scope of the present disclosure. The number of constituent elements and their locations, shapes, and so forth are not limited to any of the structure for performing the methodology illustrated in the drawings.

What is claimed is:

1. A fixing device comprising:

a fixing rotator;

a pressure rotator to press against an outer circumferential surface of the fixing rotator;

a nip formation pad disposed inside the fixing rotator and opposite the pressure rotator to form an area of contact between the fixing rotator and the pressure rotator; and a slide member disposed between the fixing rotator and the nip formation pad and applied with lubricant to slide the fixing rotator in a sliding direction, the slide member including:

first strands disposed parallel to the sliding direction; and second strands disposed perpendicular to the sliding direction and interwoven with the first strands, the first strands being woven over the second strands longer than the second strands woven over the first strands, and the first strands of the slide member are thicker than the second strands of the slide member.

2. The fixing device according to claim 1, wherein there are fewer of the second strands of the slide member per unit area than the first strands of the slide member per unit area.

3. The fixing device according to claim 1, wherein only the first strands of the slide member face the fixing rotator.

4. The fixing device according to claim 3, the first strands of the slide member are woven alternately with respect to one second strand of the slide member.

5. An image forming apparatus comprising:

an image forming device to form a toner image; and a fixing device to fix the toner image formed by the image forming device on a recording medium, the fixing device including:

a fixing rotator;

a pressure rotator to press against an outer circumferential surface of the fixing rotator;

a nip formation pad disposed inside the fixing rotator and opposite the pressure rotator to form an area of contact between the fixing rotator and the pressure rotator; and a slide member disposed between the fixing rotator and the nip formation pad and applied with lubricant to slide the fixing rotator in a sliding direction, the slide member including:

first strands disposed parallel to the sliding direction; and second strands disposed perpendicular to the sliding direction and interwoven with the first strands, the first strands being woven over the second strands longer than the second strands woven over the first strands, and the first strands of the slide member are thicker than the second strands of the slide member.

6. A sliding member applied with lubricant to slide a fixing rotator to fix an image on a recording medium, the sliding member comprising:

first strands disposed parallel to a sliding direction in which the fixing rotator slides on the slide member; and second strands disposed perpendicular to the sliding direction and interwoven with the first strands, the first strands being woven over the second strands longer than the second strands woven over the first strands, and the first strands are thicker than the second strands.

7. The sliding member according to claim 6, wherein there are fewer of the second strands per unit area than the first strands per unit area.

* * * * *